United States Patent [19]

Hayman et al.

[11] Patent Number: 4,684,154

[45] Date of Patent: Aug. 4, 1987

[54] CLIPBOARD FOR ONE-WRITE CHECK WRITING AND RECORDING SYSTEMS

[75] Inventors: Eric R. Hayman, Warren, N.J.; Scott R. Penniman, Springhouse, Pa.

[73] Assignee: Shaw/Walker Company, Millburn, N.J.

[21] Appl. No.: 829,372

[22] Filed: Feb. 13, 1986

[51] Int. Cl.[4] ..... B41L 3/00; B41L 3/06

[52] U.S. Cl. ..... 282/29 R; 282/29 A; 282/29 B

[58] Field of Search ..... 282/29 R, 29 A, 29 B, 282/29 C

[56] References Cited

U.S. PATENT DOCUMENTS

| | | | |
|---|---|---|---|
| 2,286,676 | 6/1942 | Godley . | |
| 2,338,553 | 1/1944 | Straus . | |
| 2,485,513 | 10/1949 | Straus . | |
| 2,598,358 | 5/1952 | Connor . | |
| 2,711,911 | 6/1955 | Zalkind | 282/29 B |
| 3,236,542 | 2/1966 | Russell, III . | |
| 3,291,505 | 12/1966 | Bell, Jr. et al. | 282/29 B |
| 3,480,298 | 10/1967 | Garber . | |
| 3,645,561 | 2/1972 | Kendall | 282/29 B |
| 3,722,922 | 3/1973 | Perez | 282/29 B |
| 3,752,504 | 8/1973 | Dixon | 282/29 B |
| 4,002,356 | 1/1977 | Weidemann | 282/29 B |
| 4,332,400 | 6/1982 | Hayman | 282/3 A |
| 4,591,188 | 5/1986 | Hensel et al. | 282/29 B |

FOREIGN PATENT DOCUMENTS

| | | | |
|---|---|---|---|
| 0325109 | 12/1957 | Switzerland | 282/29 B |

*Primary Examiner*—Howard N. Goldberg
*Assistant Examiner*—Taylor J. Ross
*Attorney, Agent, or Firm*—Caesar, Rivise, Bernstein, Cohen & Pokotilow, Ltd.

[57] ABSTRACT

A clipboard is disclosed for use in holding a plurality of sheets having means along one edge thereof for positioning the sheets on the clipboard. The clipboard includes a base for supporting and positioning the sheets and a clamping member at one edge of the base for holding the sheets on the base. Pivot control mechanisms at the edge of the base are provided to attach the clamping member to the base and to control the pivotal and horizontal movement of the clamping member with respect to the base. Biasing members are provided adjacent the clamping member which urged the clamping member to alternatively pivot toward the base or move horizontally with respect to the base. In addition, a separate ejector mechanism is located underneath the clamping member for ejecting sheets positioned on the base and for further spacing sheets on the base vertically so that an additional sheet can be inserted thereinbetween.

14 Claims, 17 Drawing Figures

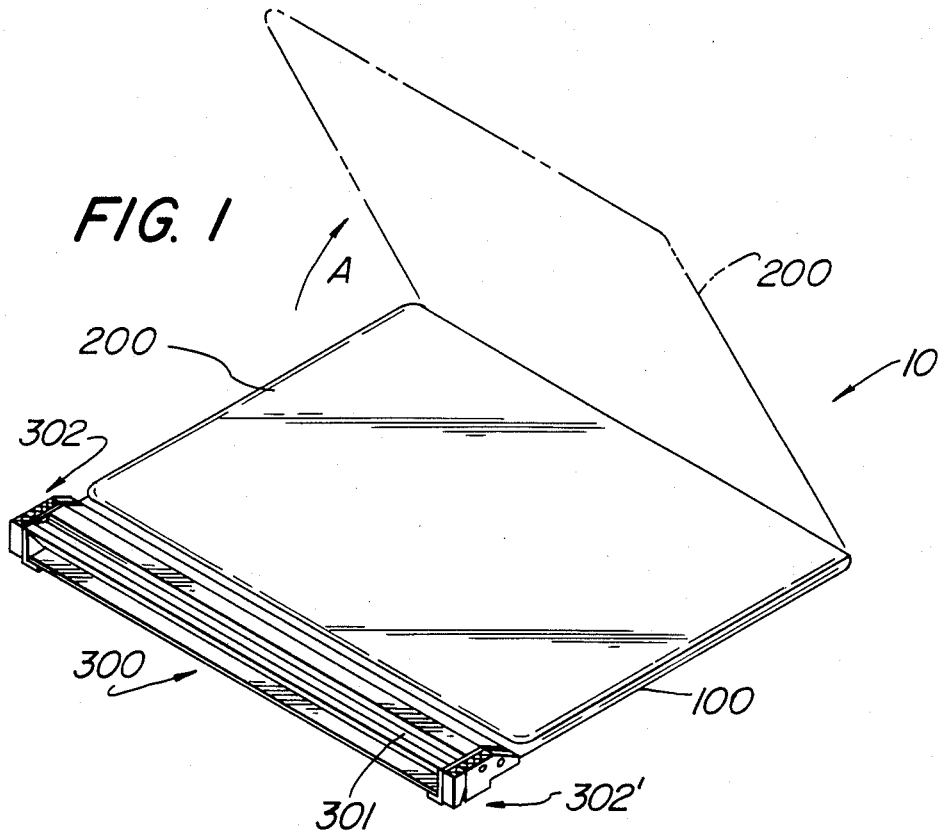
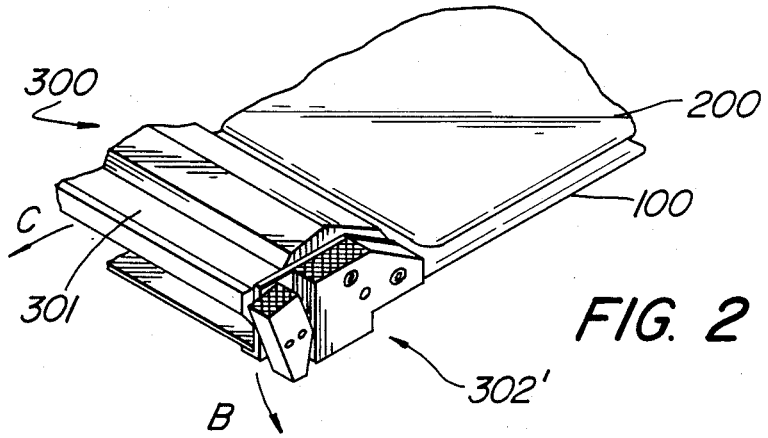
FIG. 2

302
5
328a
407
5
6
322
405
6
NUMBER
NAME
329a
17
11
331a
107
15
14
20
300
407
406
12
12
107
409
407
200
10
107
10
322
329b
331b
302'
328b 302
317
307a
306a
318
321a
321b
306b
311
316
315
322a
322b
307b
323
313
314
304
303
325
328
308a
310
309
312
308b
327
305
338
324
109
108
106
326
331a
401

402
107
408
332
13
106
333
20
402
11
331a
403
401

200
202
201
204
103
203
106
206
105
205

11
20
13
100
300
406
301
400
335
107
410
409
404
102
101
328
336
331a 14
17
18
12
15
16

F
408
406
409
D
G
107
20
336
404
331a
328

CLIPBOARD FOR ONE-WRITE CHECK WRITING AND RECORDING SYSTEMS

BACKGROUND OF THE INVENTION

The present invention relates to the field of record keeping and in particular relates to devices for clamping and retaining record keeping forms in a fixed position one above the other in one-write record keeping systems.

One-write record keeping systems have been known and in use for many years. Such systems generally comprise a base record sheet which is overlaid with a plurality of individual data slips held together along one side to form a data sheet. The data slips have specific areas for entering information thereon, and the information entered onto each data slip is transferred directly to the underlying record sheet. Such transfer is accomplished by carbon backing on the data sheet or by use of chemically treated paper.

One specific example of such a one-write record keeping system is a check and ledger system which enables checks to be written and the data written on the checks simultaneously entered onto a ledger positioned thereunder. The ledger or journal entry page (record sheet) has a series of horizontal lines onto which the check data is to be transferred. Each check (data slip) has a horizontal data line onto which data is written, such as the date, amount and the payee of the check, and on the reverse side of the check, aligned with the data line, is a carbon strip. A series of checks overlie the journal page in an overlapping relationship. The checks are shingled in such a manner that the carbon strips overlie the horizontal lines on the journal page and are held together on a single strip on the left edge thereof. Thus, when a check is written, the writer simply enters the number, payee and date on the top surface of the check and the entered information is immediately transferred through the carbon strip on the back of the check on the journal page. The individual checks can thereafter be removed one at a time from the strip on the left edge along a perforated line between the check and the strip.

The record sheet and data sheet are usually held in position one above the other on a hard-surfaced clipboard. The record sheet has a series of holes vertically aligned along the left hand margin therof which are designed to fit over spaced pegs extending upwardly from the clipboard. The data slips have corresponding holes vertically aligned along the left hand margin as well. The data slips, however, are perforated along the left hand margin so that they may be removed one at a time from the clipboard after the information has been entered. A clamping mechanism affixed to the clipboard and extending over the holes in the left hand margins of the record sheet and data slips holds both the record sheet and data slips in place around the upright pegs on the clipboard.

Rather than provide the underlying ledger or record sheet with holes which fit over the pegs, in some instances the record sheet is provided with appropriately spaced notches along the left hand margin which simply abut the upright pegs on the clipboard when the record sheet is positioned thereagainst. In still other instances, often when the clipboard is fitted with the record sheet and data slips attached as a data sheet, it is desirable to insert a third or intermediate sheet between the data slips and the record sheet so that the information written on the data slips will be entered on yet another sheet at the same time it is entered on the data slips. This intermediate sheet can have notches along the left hand margin so that it may abut the upright pegs and be appropriately aligned between the data slips and record sheet. A major drawback to inserting the intermediate sheet between the data slips and record sheet is the strip of stubs which remains after the individual data slips are removed along their left hand perforation. The strip of stubs which remains surrounding the pegs interferes with the insertion of the intermediate sheet because it prevents the intermediate sheet from reaching all the way to the upright pegs.

Accordingly, in order to enable the fast and accurate insertion and alignment of an intermediate sheet between the data slips and record sheet, an arrangement is necessary which allows the intermediate sheet to be quickly and easily inserted between the data slips and the record sheet and aligned in position against the upright pegs without interference with the stub strip of the data slips.

OBJECTS OF THE INVENTION

With the above background in mind, it is a primary object of the present invention to provide a clipboard for a one-write recording system which has an improved clamping assembly which can selectively press against the records to be written upon to prevent their removal from the clipboard and which can be easily and completely rotated away from the upright pegs and the records to be written upon to facilitate their insertion onto and removal from the clipboard.

It is a further object of the invention to provide a clipboard wherein record sheets having notched alignment indicators can be easily inserted underneath data slips and stubs of data sheets already positioned around the pegs on the clipboard.

It is a still further object of the invention to provide a clipboard for a one-write system which has an improved ejector assembly for more easily removing data slips positioned around the pegs on the clipboard and for spacing the data slips above the record sheet.

SUMMARY OF THE INVENTION

More specifically, the present invention provides a clipboard for use with one-write record keeping systems wherein generally a data sheet, which comprises a plurality of data slips attached to a strip along one edge, and a record sheet thereunder are held in position on pegs projecting upwardly from the base of the clipboard. A clamping member at one edge of the base holds the record and data sheets in position on the base. Pivot control mechanisms at the edge of the base attach the clamping member to the base and control the pivotal and horizontal movement of the clamping member with respect to the base and the record and data sheets thereon. Biasing members are provided adjacent the clamping member to urge the clamping member to pivot toward the base and force against the sheets thereon or to move parallel to the base so that the clamping member can be completely pivoted away from the base. A separate ejector is positioned adjacent the upright pegs underneath the clamping member so that the upper data sheet or strip of stubs which remains after the data slips are removed from the data sheet can be ejected from around the upright pegs. The ejector is also constructed such that a spacing is provided between a data sheet and the data slips comprising the data sheet on top of the ejector and a record sheet thereunder. By means of this spacing, a third sheet can be inserted between the data and record sheets to abut the upright pegs.

BRIEF DESCRIPTION OF THE DRAWINGS

Other objects and many of the attendant advantages of the instant invention will be readily appreciated as the same becomes better understood by reference to the following detailed description when considered in connection with the accompanying drawings wherein:

FIG. 1 is a perspective view of the clipboard of the present invention showing the cover of the clipboard in phantom position in the open and in full line in the closed position;

FIG. 2 is an enlarged fragmented perspective view of the clipboard of the present invention showing in detail an exterior view of one pivot member of the clamping mechanism;

DETAILED DESCRIPTION OF THE PREFERRED EMBODIMENT

Figure 3:
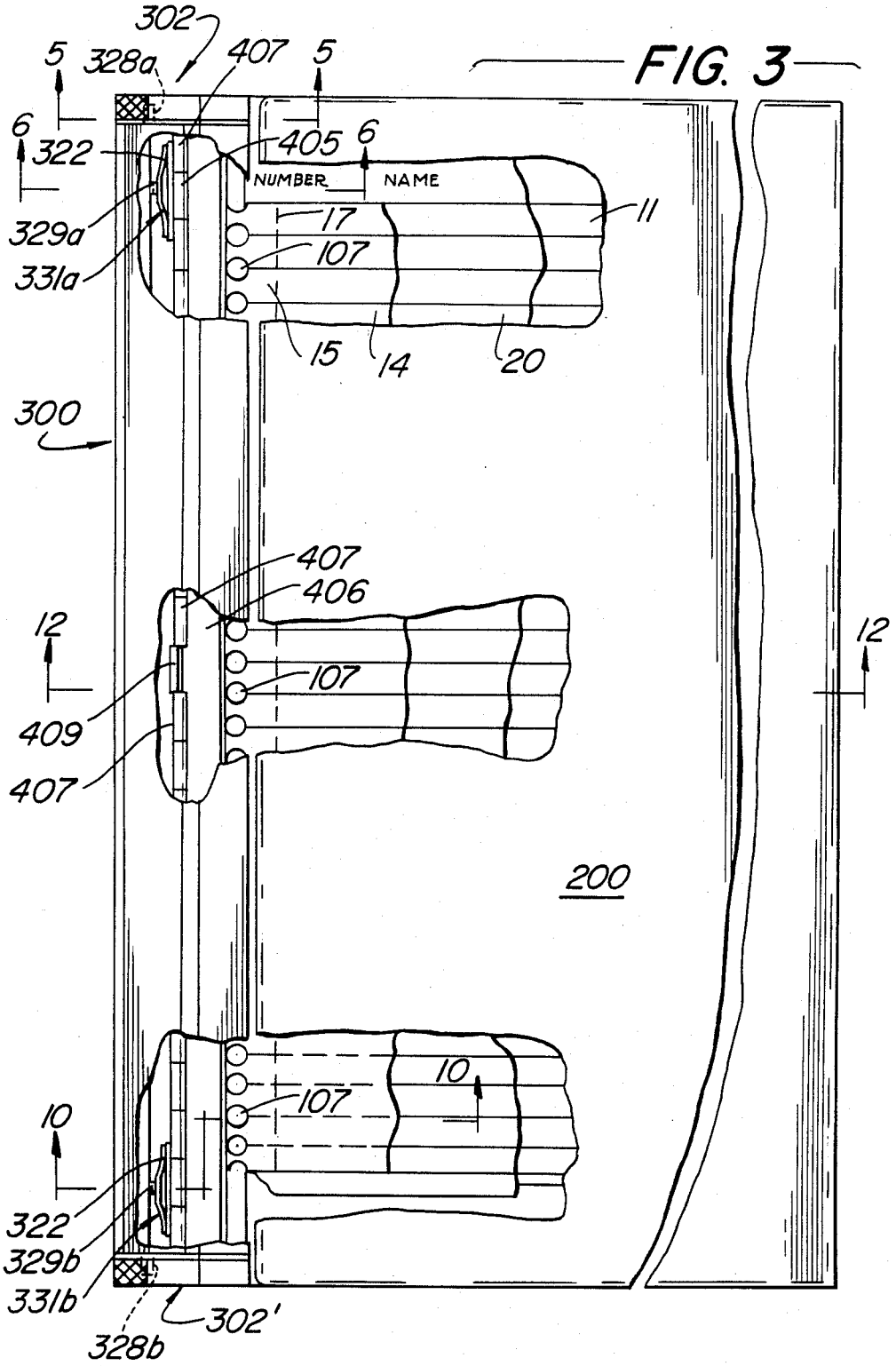
FIG. 3 is a plan view of the clipboard and clamp of the present invention partially cut-away to show the arrangement of record keeping sheets on the clipboard and the structure of the clamp.

Referring in greater detail to the various figures of the drawings wherein like reference characters refer to like parts, a clipboard for one-write check writing and recording systems embodying the present invention is generally shown at 10 in FIG. 1. The clipboard assembly comprises generally a base 100, a cover 200, and a clamping mechanism 300 affixed along the left edge of the base 100.

Figures 12, 13, 14:
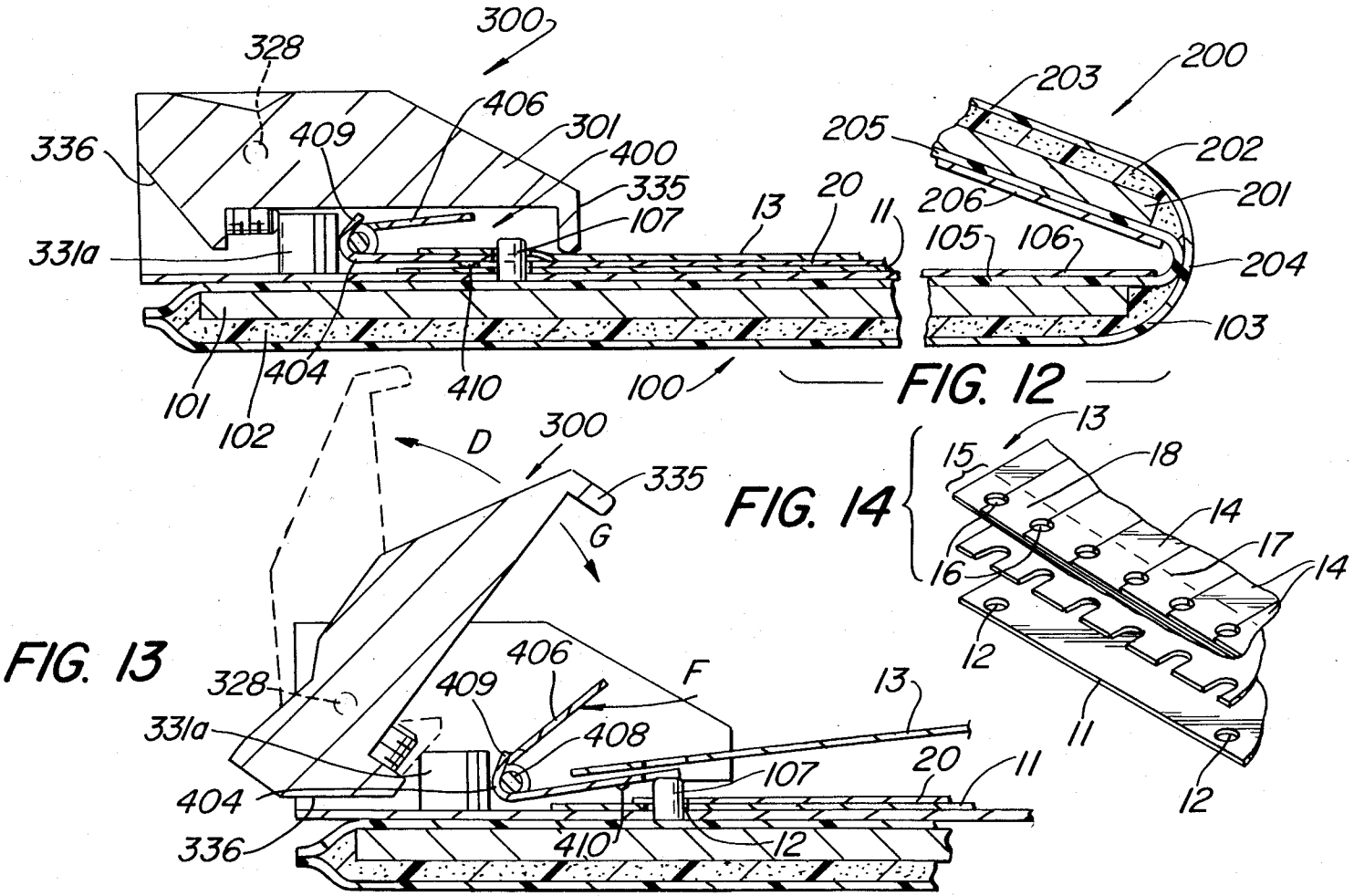
FIG. 12 is an enlarged sectional view taken along line 12—12 in FIG. 3 showing the clamping bar in the clamping position against the sheets on the clipboard.
FIG. 13 is a sectional view of the clamping bar as shown in FIG. 12 showing the clamping bar fully pivoted away from the sheets on the clipboard and showing movement of the floating ejector.
FIG. 14 is a perspective view showing the arrangement of a data sheet aligned above a record sheet with a second, notched record sheet aligned thereinbetween.

In the preferred embodiment, as shown for example in FIG. 12, the base 100 and cover 200 are formed from sheet material 101, 201, a layer of padding 102, 202, next to the sheet material, and a covering 103, 203 surrounding the sheet and padding. The coverings of the base and cover are preferably integrally combined to form a living hinge structure 204, so that the cover may be folded over the base. Affixed to the top surface 105 of the base 100 and the surface 205 of the cover 200 opposing the top surface 105 when the cover 200 is closed over the base are solid top sheets 106, 206 which provide suitable writing surfaces. The top sheets 106, 206 may be of any rigid and, preferably, non-flexible material such as sheet metal or hardened plastic, and may be affixed to the surfaces 105, 205 of the base and cover by adhesives, bonding, riveting or other suitable means. The sheet material 101, 201 may be of any suitable rigid material such as cardboard or compressed paper, and the padding 102, 202 is preferably foam padding. The covering 103, 202 may be vinyl.

Affixed to and extending through the solid sheet 106 are pegs or pins 107. These pegs are spaced from each other a predetermined distance along the left side of the sheet 106. The pegs 107 may be of any suitable hardened material, such as metal or plastic.

Figures 4, 11:
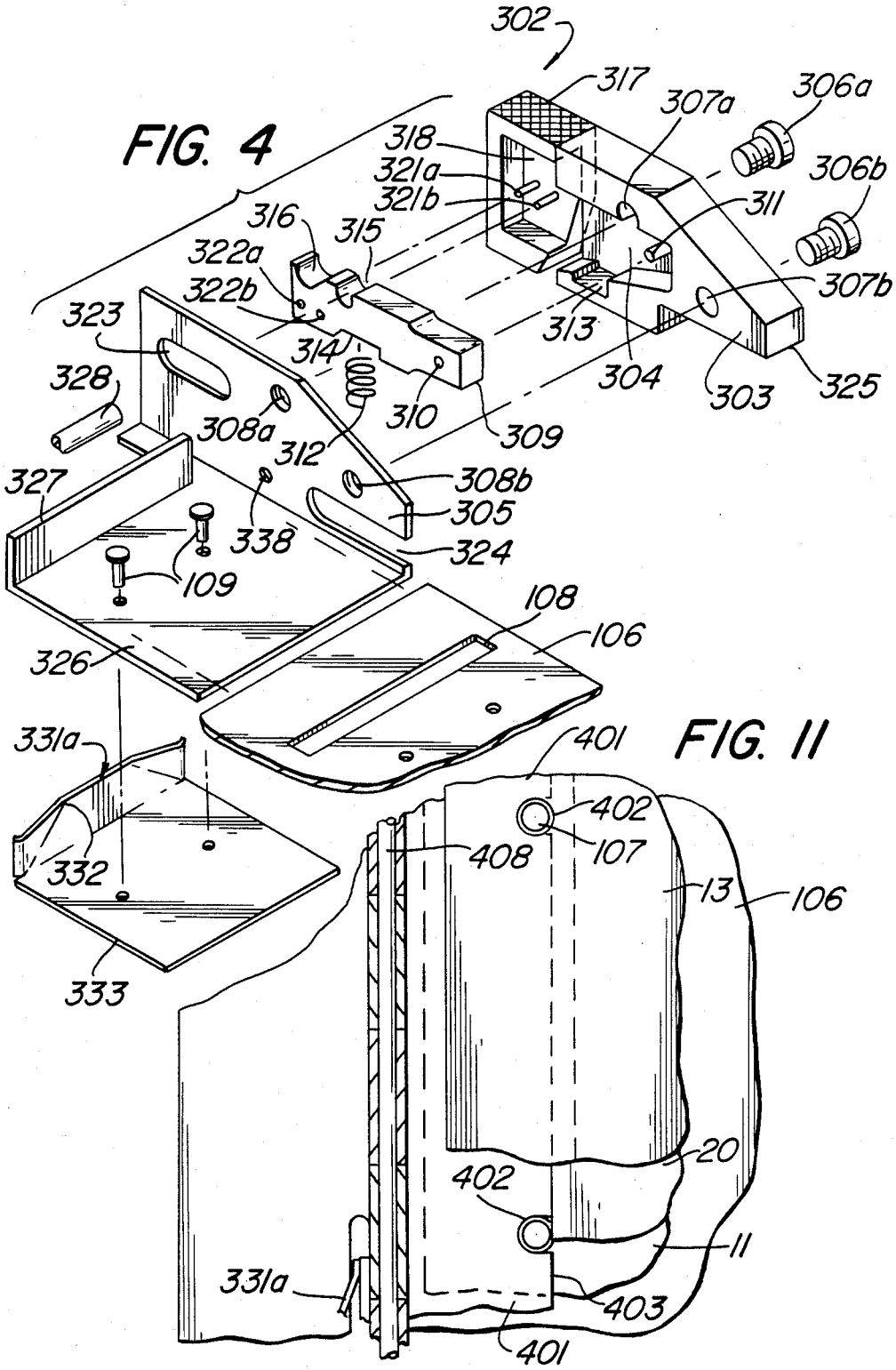
FIG. 4 is an enlarged exploded perspective view of a pivot member of the clamping mechanism.
FIG. 11 is a sectional view taken along line 11—11 in FIG. 10.

When the clipboard assembly 10 is in use as shown in FIGS. 3, 11 and 14, a record sheet 11 having a plurality of holes 12 along the left hand margin is placed on the top sheet 106 of the base 100 and the holes 12 are aligned around the pegs 107, thereby positioning the record sheet 11 on the base 100. After the record sheet 11 is in place, a second sheet or data sheet 13 for recording data thereon is placed over the record sheet 11. Usually, the data sheet 13 (See FIG. 14) is comprised of a plurality of individual overlapping data slips 14 joined together along their left hand margins to form a strip 15 having a plurality of aligned holes 16 therein which, too, are fitted over the pegs 107, so that the data slips 14 are properly positioned and aligned over the record sheet 11.

The data slips 14 are positioned above the record sheet 11 in such a manner that a line on which pertinent data is entered on each data slip is aligned directly above a given line on the record sheet 11 therebeneath. The reverse side of the data slip 14 directly behind the portion of the data slip on which the information is entered may be coated with a pressure-sensitive carbon backing which will transfer the data written on the face of the data slip 14 to the appropriate line of the record sheet 11 beneath it. Alternatively, the data slips and the record sheet may be of chemically treated paper which will transfer impressions from the top data slip 14 to the bottom record sheet 11.

As a practical example, the data slips 14 oftentimes are checks and the record sheet 11 is a ledger sheet positioned beneath the checks. When a check is written, the information written on the check, i.e., the payee, the amount, the client account, etc., is immediately transferred onto the ledger card without the necessity of rewriting the information. The checks are removed from the strip 15 containing the holes 16 by means of perforations 17 which extend along the entire length of the left hand edge of the check. After each check (data slip) is removed a stub 18 remains on the strip 15 around the pegs. After all of the checks have been removed along their perforations 17, the strip 15 of stubs 18 remains around the pegs 107 above the record sheet 11. The strip 15 is removed by lifting it away from the pegs 107.

In order to keep the data sheet 13 (with the data slips 14) and the record sheet 11 in position around the pegs 107, the clamping mechanism 300 is provided along the left side of the base 100. As shown in FIG. 12, the clamping mechanism 300 extends over the pegs 107 and forces against the data sheet 13 and the record sheet 11.

The clamping mechanism 300 and its operation are shown in FIGS. 2, 4–10, 12 and 13. The force exerted against the data slips 14 comprising the data sheet 13 which keeps the data sheet 13 securely in position around the pegs 107 is provided by a clamping bar 301 which, as best seen in FIG. 1, extends completely along the left side of the base 100 and is secured between two pivot members, each generally shown as 302. These two pivot members 302 control the movement of the bar 301 about a pivot axis therebetween.

The two pivot members 302 are substantially mirror images and otherwise identical in structure; therefore, a description of only one member 302 is provided. As shown in FIG. 4, the pivot member 302 comprises a housing 303 with a first cavity 304 on the inner surface thereof. A cover plate 305 attached to the top sheet 106 at the base is provided to cover the cavity 304. Two screws 306*a*, 306*b* pass through openings 307*a*, 307*b*, respectively, and engage two threaded holes 308*a*, 308*b* in the cover plate 305 to hold the cover plate 305 against the housing 303 and over the first cavity 304.

Figure 5:
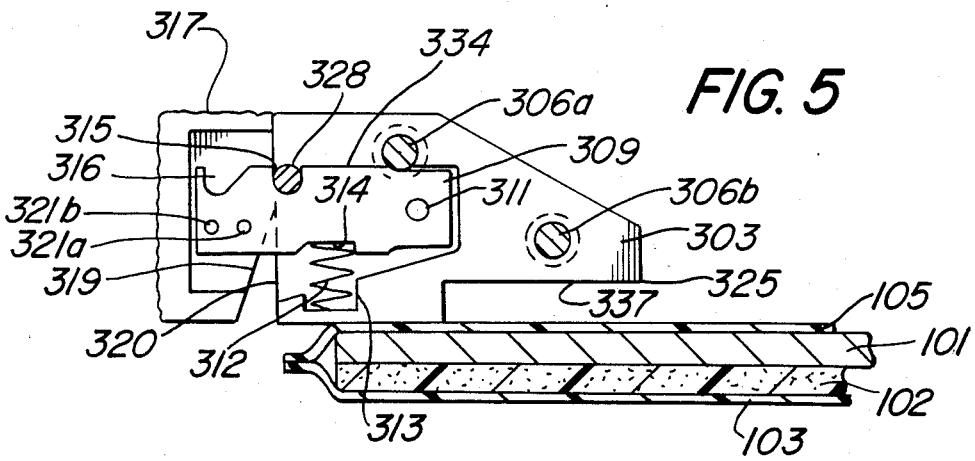
FIG. 5 is an enlarged sectional view of the pivot member of the clamping mechanism in the locked position taken along line 5—5 in FIG. 3.

A lever 309 having a hole 310 therethrough at one end is pivotably mounted on a pin 311 fitted through the sidewall of the housing and extending into the cavity 304 of the housing 303. As also shown in FIG. 5, the lever 309 is biased upwardly within the cavity 304 by a spring 312 removeably positioned between a groove 313 in the cavity 304 and a notch 314 in the lever 309. The end of the lever 309 opposite the hole 310 has two grooves 315, 316 in the upper surface. The use of these grooves will become apparent later in this description.

Figure 7:
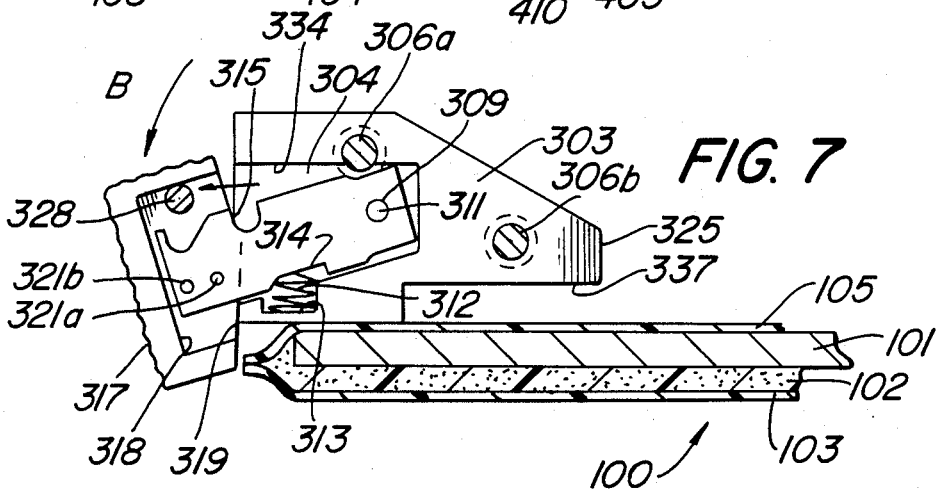
FIG. 7 is an enlarged sectional view of the pivot member of the clamping mechanism as shown in FIG. 5 in the unlocked position.
Figure 8:
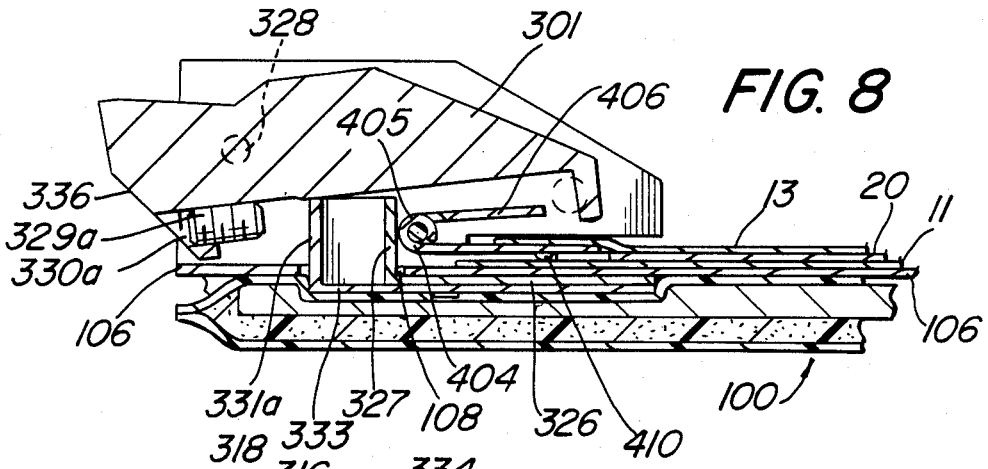
FIG. 8 is an enlarged sectional view of the clamping bar as shown in FIG. 6 with the clamping bar released from its locked position.
Figure 9:
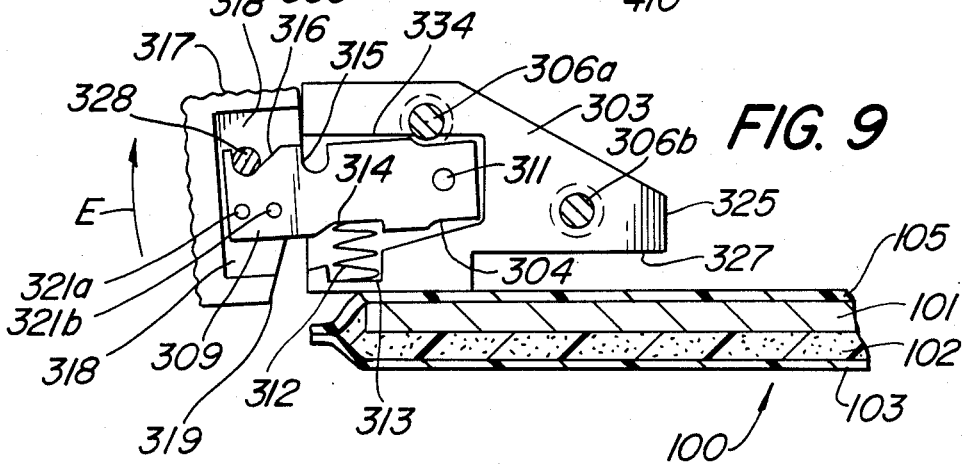
FIG. 9 is an enlarged sectional view of the pivot member of the clamping mechanism as shown in FIGS. 5 and 7 wherein the pivot member is being moved into the locking position.

As best seen in FIGS. 4, 5 and 7, adjacent the housing 303 is a knob 317 with a second cavity 318. Each of the cavities 304, 318 is open along one edge thereof 319, 320, and these two open edges are aligned with each other. The cavity 318 in the knob 317 receives the end of the lever 309 opposite the end containing the hole 310. The end of the lever 309 within the cavity 318 is attached to the knob 317 by two pins 321*a*, 321*b* projecting from the inside of the cavity 318 and which fit into two holes 322*a*, 322*b*, respectively, in the lever. As shown in FIG. 5, the lever 309 fitted in the cavities 304, 318 extends through the aligned open edges 319, 320 of the cavities.

The cover plate 305, as shown in FIG. 4, not only covers the cavity 304 in the housing 303, it also extends rearward to cover the cavity 318 in the knob 317 as well. An elongated opening 323 is provided through the cover plate 305 and extends between the two cavities 304, 313. An elongated groove 324 is provided in the forward edge of the cover plate 305 the top surface of which coincides in height with the bottom surface 337 adjacent the forward edge 325 of the housing 303 when the housing 303 and the cover plate 305 is connected to the top sheet 106.

The cover plate 305 has at the bottom edge thereof an integral rectangular horizontal extension 326 projecting at a right angle from the upwardly projecting body portion of the cover plate previously discussed. In addition, the rectangular horizontal extension 326 of the coverplate has a vertical extension or flange 327 projecting upward therefrom at a right angle transverse to the right angle formed between the horizontal extension 326 and the body portion of the cover plate 305. The cover plate 305 is preferably one metal plate which is cut and bent to include the two right-angled extensions 326 and 327 integrally therewith.

The horizontal extension 326 of the cover plate 305 extends underneath the top sheet 106 of the base, and the vertical extension 327 extends upwardly through an elongated opening 108 provided in the top sheet 106. Rivets 109 inserted through the top sheet 106 and the horizontal extension 326 securely connect the cover plate 305 to the top sheet 106. While rivets are a preferred means for connecting the cover plate 305 and top sheet 106, it is recognized that other methods of connecting these components are available.

As best seen in FIG. 3, the clamping bar 301 extending between the two pivot members 302' and 302 has a rod-like projection 328*a* and 328*b* at each end thereof. Both projections 328*a* and 328*b* extend through the respective oblong openings 323 in the cover plates 305 and extend into the spaces defined by the two cavities 304 and 318. As will be discussed hereinafter, during the operation of the clamp, the projections 328*a* and 328*b* move between the grooves 315, 316 in the levers 309 of each pivot member 302.

Figure 6:
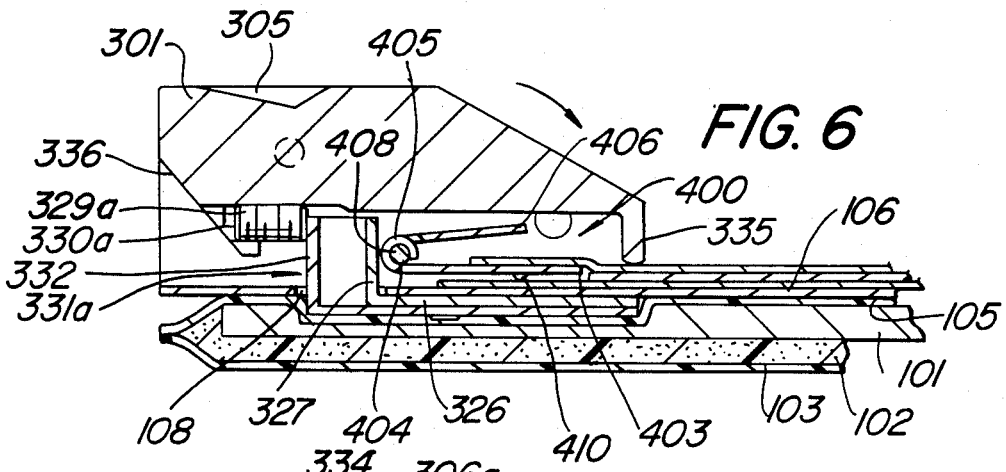
FIG. 6 is an enlarged sectional view of the clamping bar in the locked position and the ejector taken along line 6—6 in FIG. 3.

As shown in FIGS. 3, 6, 8 and 10, the clamping bar 301 has threaded screws 329*a*, 329*b* which screw through threaded holes 330*a*, 330*b* in the lower rearward edge 336 of the bar. The two screws 329*a*, 329*b* are adjustable toward and away from two spring steel biasing members 331*a*, 331*b* positioned behind the vertical flanges 327 of each of the cover plates 305. In this embodiment, preferably the spring steel members 331*a*, 331*b* form a right angle, the vertical portion 332 of which passes through the elongated opening 108 in the top sheet 106 and the horizontal portion 333 of which extends underneath the top sheet 106 and the horizontal extension 326 of the cover plate 305. The rivets 109, 109 which hold the horizontal extension 326 of the coverplate against the top sheet 106 also pass through and retain the horizontal portion 333 of each spring steel member 331*a*, 331*b* against the horizontal extension 326 of the cover plate 305. It is further shown in FIG. 3 that the vertical portion 332 of the spring steel members 331*a*, 331*b* is substantially "U"-shaped, so that it will bias toward any force exerted thereagainst. In this instance, the "U"-shaped portions of the spring steel members are positioned to bias against the set screws 329*a*, 329*b* threaded through the clamping bar 301, when the clamping bar 301 is in the horizontal locked position as shown in FIGS. 6 and 12.

Figure 15:
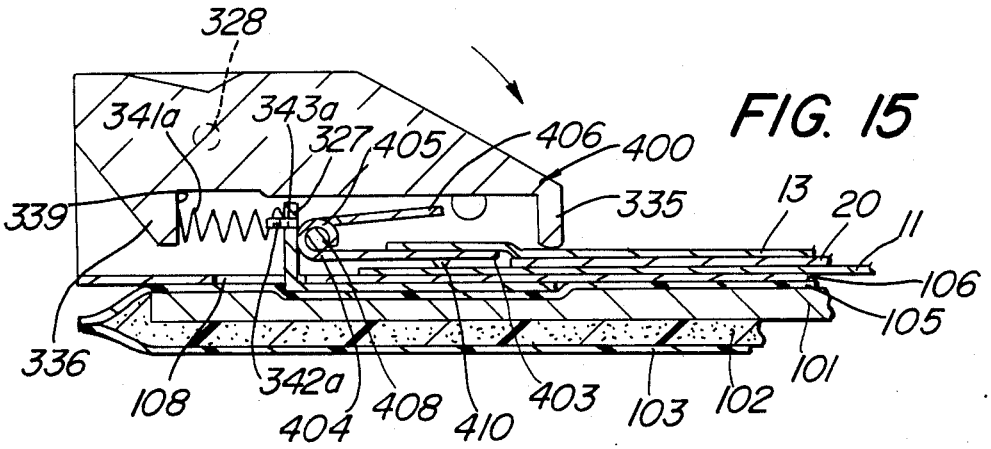
FIG. 15 is an enlarged sectional view of the clamping bar in the locked position and the ejector taken along line 6—6 in FIG. 3 showing an alternate embodiment of the biasing member.
Figure 16:
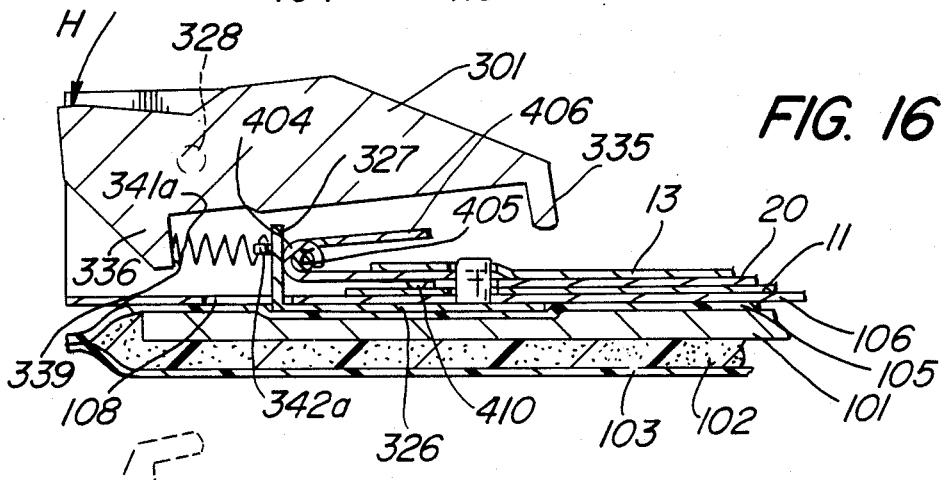
FIG. 16 is an enlarged sectional view taken along line 10—10 in FIG. 3 showing the alternate embodiment of the biasing member when the clamping bar is being depressed and lifted away from the sheets on the clipboard.
Figure 17:
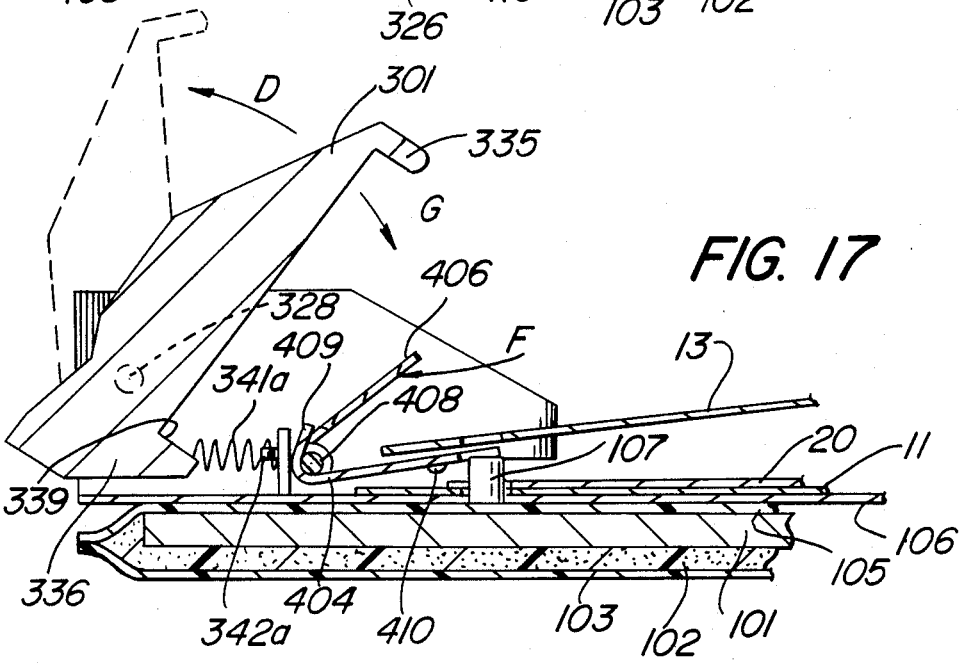
FIG. 17 is a sectional view of the clamping portion of the clipboard of the invention showing an alternate embodiment of the biasing member when the clamping bar is fully pivoted away from the sheets on the clipboard.

An alternate embodiment of the biasing member acting on the clamping bar 301 is shown in FIGS. 15–17. The two screws 329*a*, 329*b* through the lower rearward edge 336 of the clamping bar 301 are eliminated, as are their respective threaded holes 330*a*, 330*b*. The lower rearward edge 336 has no holes therethrough. Also eliminated are the spring steel biasing members 331*a*, 331*b* positioned behind the vertical flanges 327 of each of the cover plates 305. In place of the spring steel biasing members 331*a*, 331*b* are two helical spring biasing members 341*a*, 341*b* which are attached directly to the vertical flanges 327 of each cover plate 305. The springs 341*a*, 341*b* are attached by screws 342*a*, 342*b* threaded through holes 343*a*, 343*b*, respectively, in the vertical flanges 327. These springs 341*a*, 341*b* bias directly against the inside surface 339 of the lower rearward portion of the clamping bar 301 in the same manner the spring steel members 331*a*, 331*b* bias against the screws 329*a*, 329*b*.

To use the clipboard and clamping system of the present invention, the first step is to open the cover 200, as shown in FIG. 1 in the direction indicated by arrow A. After the cover 200 is opened (FIG. 12), the top sheet 106 on the base 100 is exposed and a journal or record sheet 11 can be loaded by fitting the holes 12 in the record sheet 11 around the pegs 107. First, however, the clamping mechanism 300 must be unlocked which is done by lifting the clamping bar 301. Lifting the clamping bar 301 exposes the pegs 107 around which the holes 12 in the record sheet 11 are fitted.

The components of one pivot member 302 are shown in the closed position in FIG. 5. Reference is made to only one pivot member 302, since the mirror image pivot members 302, 302' operate in an identical manner. The lever 309 in FIG. 5 is pivoted or biased upwardly about pin 311 by the spring 312 against the top surface 334 of the cavity 304 in the housing 303. The projection 328 extending from one end of the clamping bar 301 is held within groove 315 beneath the top surface 334.

The closed position of the clamping bar 301 is shown in FIG. 6. The clamping bar 301 is in a horizontal position, with the forward lip 335 directed downwardly toward the sheets on the base 100. The set screws 329*a*, 329*b* passing through the clamping bar 301 force against the spring steel members 331*a*, 331*b*. The rearward force exerted against the set screws 329*a*, 329*b* by the spring steel members 331*a*, 331*b* causes the clamping bar 301 to pivot about the projections 328 and force the forward lip 335 downwardly. The clamping bar 301 as a whole is prevented from being urged backwards by the spring steel members 331*a* and 331*b* because the projections 328 are held against any horizontal movement in the first groove 315 in the lever 309 of each pivot member 302.

To release the clamping bar 301 from the locked position shown in FIG. 6, each knob 317 is manually forced downwardly as indicated by arrow "B" in FIGS. 2 and 7. The downward force against each knob 317 causes the lever 309 attached thereto to pivot about pivot pin 311 against the force of the spring 312. When each lever 309 moves downward, each projection 328*a* and 328*b* on the clamping bar 301 is released from its position within the groove 315 in each lever 309 and the clamping bar 301 is urged rearward by the spring steel members 331*a* and 331*b* forcing against the set screws 329*a* and 329*b* as shown by arrow "C" in FIGS. 2 and 8 and the configuration of the elements shown in FIG. 8.

After each projection 328*a* and 328*b* is released from the first groove 315 in each lever 309 and the bar 301 is forced rearward, the bar 301 is free to be lifted or rotated upwardly as shown in FIG. 13 by arrow "D". The lower rearward edge 336 of the clamping bar 301, through which the threaded holes 330*a*, 330*b* pass, has an angled shape so that the clamping bar 301 can rotate without engaging the spring steel members 331*a*, 331*b* as shown in phantom in FIG. 13. When the clamping bar 301 is lifted or rotated as shown in FIG. 13, the projections 328*a* and 328*b* slide rearward into the second grooves 316 in each lever 309. The second grooves 316 in each lever 309 are sloped on the side near the first groove 315 to faciliate the sliding movement of the projections 328*a*, 328*b* thereinto. As soon as the projections 328*a*, 328*b* slide into each of the second grooves 316, each lever 309 and the knob 317 attached thereto is forced upwardly into the horizontal position by the force of the springs 312 acting against the levers 309. (Arrow "E" in FIG. 9).

With the clamping bar 301 rotated to its maximum limit, (as shown in phantom in FIG. 13) the pegs 107 are exposed and ready to receive the record sheet 11. The holes 12 in the record sheet 11 are aligned with the pegs 107 and the record sheet is pushed into position. After the record sheet 11 is in position over the pegs, the data sheet 13 is positioned over the record sheet by aligning the holes 16 in the strip 15 of the data sheet with the pegs 107 and pushing the data sheet into position.

To remove or change the data sheet 13 or remove the strip 15 of stubs 18 which remains after some or all of the data slips 14 have been torn away, the strip 15 or data sheet 13 is simply lifted away from the pegs. In the present invention, any remaining data slips or strip 15 are easily released from the pegs 107 by using an ejector 400 to lift the data slips or strip of stubs.

As best seen in FIG. 3, the ejector 400 of the present invention is mounted on the clipboard between the two pivot members 302, 302'. As further shown in FIG. 11, the ejector 400 includes a first ejector strip 401 which has a plurality of indentations 402 along one edge 403 thereof. The indentations 402 correspond to the locations of the pegs 107 positioned on the solid sheet 106. Each indentation 402 is positioned substantially, but not completely, around a peg associated therewith. As shown in FIGS. 6, 8, 10, 12 and 13, the rearward edge 404 of the first ejector strip 401 opposite the edge 403 containing the indentations 402 is formed with a plurality of spaced curled strips 405, and a second ejector strip 406 also has spaced curled strips 407 along one edge thereof. The spaced curled strips 407 of the second ejector strip are fitted between the curled strips 405 of the first ejector strip 401 and a piano hinge arrangement is created. A slender rod 408 is fitted through the piano hinge arrangement to provide a pivot location about which the first and second strips can rotate. This slender rod 408 is inserted into and stationarily held between the cover plate 305 of the two pivot members 302, 302' in holes 338 in the cover plates (FIG. 4).

One strip 409 of the plurality of curled strips 405 associated with the first ejector strip 401 is not completely curled as shown in FIGS. 3, 12 and 13. Because of this construction, when the second ejector strip 406 is lifted in the direction of arrow "F" in FIG. 13 and rotated about rod 408, the second ejector strip 406 engages the partially curled strip 409 and forces the first ejector strip 401 to rotate as well.

When the ejector 400 is being used in the invention, the record sheet 11 is inserted over the pegs 107, the first ejector strip 401 is rotated downward so that the indentations 402 partially surround the pegs 107. The strip section 15 of the data sheet 13 is positioned on top of first ejector strip 401 around the pegs 107. To remove the strip section 15 or any remaining unused portion of the data sheet, the second ejector strip 406 is rotated counter clockwise, and when it engages the partially curled strip 409 the first ejector strip 401 raises and causes the data sheet or strip 15 above the first ejector strip 401 to be lifted upward and separated from the pegs. (FIG. 13).

After the clamping bar 301 has been raised to either insert or remove record or data sheets, the clamping bar 301 is pushed downward (clockwise) in the direction of arrow "G" in FIG. 13 as the first step in returning the clamping bar to its locked and clamping position (FIG. 12). After the clamping bar is returned to the horizontal position, it is pushed forward, i.e., transverse to the alignment of the pegs 107. As the clamping bar 301 moves forward, the projection 328 moves up the inclined surface of the second groove 316 in the lever 309 and forces the lever 309 downward slightly against the spring 312. Further forward movement of the clamping bar 301 causes the pivot rod 328 to enter the first groove 315 where it is held or locked in position from further forward movement due to the spring 312 forcing the lever 309 upward, thereby securing the pivot rod 328 in the first groove 315. The return of the lever 309 to its horizontal position due to the biasing force of the spring 312, also returns the knob 317 attached thereto to its vertical position. Furthermore, after the clamping bar 301 is returned to its full forward position, the set screws 329*a*, 329*b* again force against the spring steel members 331*a*, 331*b*.

One of the features of the present invention which makes it a further improvement over prior clipboard devices is the ability of the clamping mechanism to receive record sheets which are not designed to fit over the pegs 107. Record sheets are available which are notched along the left hand margin so that the notches may abut and align with the pegs 107. A drawback of the prior devices when using the notched type of record sheet is the fact that with the data sheet 13 still in place around the pegs 107 it is very difficult to align the notches of the record sheet with the pegs 107. To overcome this drawback, the first ejector strip 401 of this invention, as shown in FIGS. 6, 8, 10, 12 and 13, is provided with projections 410 which project downward from the underside thereof, so that when the first ejector strip 401 is lowered, the strip itself is spaced above the solid sheet 106 by the distance of the projections 410. The projections 410 are spaced rearward of the notched edge of the strip 401. This allows a notched-type record sheet to slide under a data sheet 13 resting on the first ejector strip and abut the pegs 107, but not the projections 410.

A second benefit of the projections 410 on the first ejector strip 401 of this invention is the ability of the device to receive a third sheet 20 (FIG. 12 and 13) inbetween the data sheet resting above the first ejector strip 401 and a record sheet fitted around the pegs 107 beneath the first ejector strip 401. When the first ejector strip 401 is lowered against the record sheet 11, the projections 410 raise the data sheet 13 above the record sheet 11 enough so that a third record sheet 20 having notches along the left margin can be inserted between the data sheet and record sheet. Thus, the third sheet 20 having alignment notches along the left margin can be aligned with and engage the pegs 107 without being interrupted by the data sheet 13 or the strip 15 of stubs which remains after the data slips 14 are removed from the data sheet 13.

The construction of the clamping mechanism 300 also makes it possible to release the pressure exerted by the forward lip 335 of the clamping bar 301 against the data sheet 13 so that the additional notched margin record sheets 20 may be inserted without completely lifting the clamping bar 301. When the clamping bar is in its down and locked position (FIG. 12), downward pressure can be exerted against the left side of the clamping bar, as shown by arrow "H" in FIG. 10, thereby causing the clamping bar 301 to pivot about the projections 328 securely held within the first groove 315 of the lever 309. This pivoting motion raises the forward lip 335 of the bar away from the data sheet 13 so that another sheet can be inserted.

The pivoting motion (FIG. 10) of the clamping bar 301 in the locked position is prevented from being great enough to completely expose the pegs 107 due to the contact of the set screws 329*a*, 329*b* with the spring steel members 331*a*, 331*b*. And because the set screws 329*a*, 329*b* are adjustable in the threaded holes 330*a*, 330*b*, the distance which the clamping bar 301 can be rotated is adjustable. When the downward force against the left side of the clamping bar 301 is removed, the forward lip 335 of the clamping bar is quickly returned to its retaining position against the data sheet 13 due to the force of the spring steel members 331*a*, 331*b* exerted against the set screws 329*a*, 329*b* which causes the clamping bar 301 to rotate toward and be forced against the data sheet 13.

The operation of the alternate embodiment clamping system shown in FIGS. 15–17 is much the same as that previously discussed, except that the springs 341*a*, 341*b* bias directly against the inside surface 339 of the rearward edge portion 336 of the clamping bar in place of the spring steel members 331*a*, 331*b* biasing against the set screws 329*a*, 329*b*. In particular when the clamping bar 301 is in the closed position as shown in FIG. 15, the springs 341*a*, 341*b* are compressed between the inside surface 339 of the clamping bar 301 and the upright flanges 327. The clamping bar 301 is prevented from being urged backwards because the projections 328*a*, 328*b* are held against horizontal movement in the first groove 315 in the lever 309 of each pivot member 302.

The clamping bar 301 is released from its downward locked position by pressing the knob 317 downward in the same manner discussed previously with respect to FIGS. 2 and 7. Each projection 328*a*, 328*b* is released from its locked position within its associated groove 315 in each lever 309 and the clamping bar 301 is urged rearward by the springs 341*a*, 341*b* forcing against the inside surface 339 of the clamping bar.

With the projections 328*a*, 328*b* released from the first groove 315 in each lever 309 and the bar 301 forced rearward, the bar 301 can be lifted or rotated upwardly as shown in FIG. 17 by arrow "D". The rotating movement of the clamping bar 301 causes the inside surface 339 thereof to urge against and compress the springs 341*a*, 341*b* so that they do not interfere with the rotational movement of the clamping bar 301. To return the clamping bar 301 to its horizontal porition it is simply rotated downward (arrow "G", FIG. 17) against the biasing force of the springs 341*a*, 341*b* and pushed forward, i.e., transverse to the alignment of the pegs 107. As discussed with the previous embodiment, when the clamping bar is pushed forward, the projections 328*a*, 328*b* move up the inclined surface of the second groove 316 in the lever 309 and into the first groove 315 where they are held or locked in position from further movement due to spring 312 forcing the lever 309 upward. After the clamping bar 301 is returned to its full forward position (FIG. 15), the springs 341*a*, 341*b* are again compressed between the inside surface 339 of the clamping bar 301 and the vertical flange 327.

Figure 10:
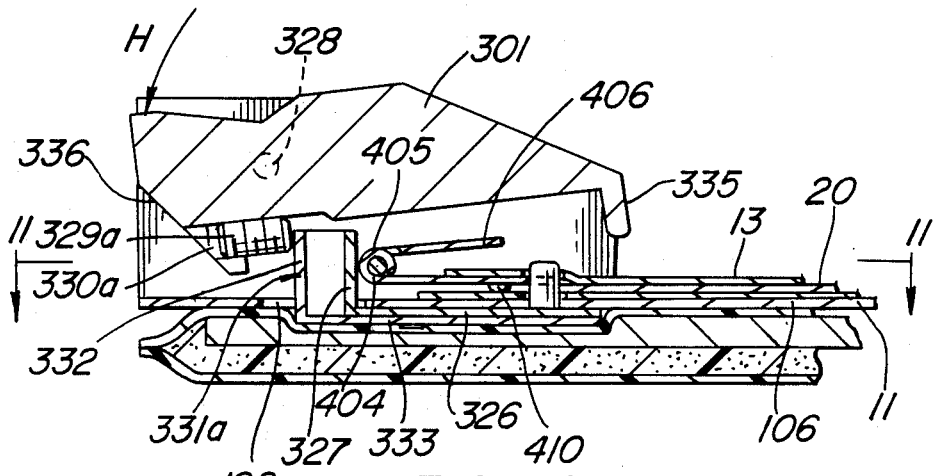
FIG. 10 is an enlarged sectional view taken along line 10—10 in FIG. 3 showing the clamping bar being depressed and lifted away from the sheets on the clipboard.

The use of the springs 341*a*, 341*b*, also does not disturb the operation of the locked position pivoting motion as previously discussed with reference to FIG. 10. As shown in FIG. 16, pressure can still be exerted on the left side of the clamping bar 301 to cause the bar to pivot about the projections 328*a*, 328*b* securely held within the first groove 315 of each lever 309, thereby raising the forward lip 335 of the bar away from the data sheet 13 so that an additional sheet can be inserted. When the downward force is applied to the left side of the bar 301 the inside surface 339 of the bar further compresses the springs 341*a*, 341*b*. The compressed springs abut the bar to prohibit complete rotational movement of the bar so that the pegs 107 are not completely exposed. When the downward pressure is removed, the compressed spring urges against the inside surface 339 of the rearward edge portion of the bar and causes the bar to rotate and force the lip 335 downward against the data sheet 13.

Without further elaboration, the foregoing will so fully illustrate my invention that others may, by applying current or future knowledge, readily adopt the same for use under various conditions of service.

What is claimed as the invention is:

1. A clipboard for holding a plurality of sheets having positioning means along one edge thereof for aligning and positioning said sheets on said clipboard, said clipboard comprising:

base means for supporting said sheets and receiving said positioning means of said sheets;

clamping means above said base means for holding said sheets on said base means;

at least one pivot means mounted on said base means and operatively connected to said clamping means for controlling the movement of said clamping means parallel to said base means and for controlling the movement of said clamping means toward and away from said base means; and first biasing means adjacent said clamping means for urging against said clamping means and causing said clamping means to rotate at said pivot means.

2. A clipboard as claimed in claim 1, comprising two pivot means, each of said pivot means being at an opposite end of said clamping means.

3. A clipboard as claimed in claim 2, wherein each pivot means is comprised of:

a housing having a first cavity therein, said first cavity being open into one side of said housing and through the rear edge of said housing;

a knob adjacent the rear edge of said housing, said knob having a second cavity therein, said second cavity being open into one side of said knob and through the forward edge of said knob, said opening through the rear edge of said housing being aligned with said opening through the forward edge of said knob;

a lever pivotably mounted within said first cavity and extending into said second cavity, said lever being connected to said knob within said second cavity at the end thereof opposite the end mounted within said first cavity, and said lever having first and second grooves therein;

second biasing means within said first cavity between said lever and the inside of said cavity for biasing said lever within said cavity; and coverplate means attached to said base means and said housing and positioned over said first and second cavities for covering said cavities and attaching each housing to said base means.

4. A clipboard as claimed in claim 3, wherein said coverplate means is comprised of:

an upright portion connected to said housing and covering said first and second cavities, said upright portion having an opening therethrough aligned with said first and second grooves in said lever; and a horizontal extension at the bottom edge of said upright portion, said horizontal extension being connected to said base means.

5. A clipboard as claimed in claim 4, wherein said clamping means is comprised of:

a clamping bar mounted between said pivot means, said clamping bar comprising:

a body portion;

a forward lip extending toward said base means at the forward edge of said body portion;

a rearward edge portion extending downward from the back edge of said body portion; and projections at each end of said body portion, each projection passing through said opening in said upright portion of said coverplate means and being receivable within one of said grooves in said lever.

6. A clipboard as claimed in claim 5, wherein said clamping bar further comprises adjustments means at said rearward edge portion of said body portion opposing said first biasing means for adjusting the force exerted by said biasing means against said clamping bar.

7. A clipboard as claimed in claim 5, wherein said first biasing means is comprised of a spring member between said upright portion of said coverplate means and said rearward edge portion of said clamping bar.

8. A clipboard as claimed in claim 7, wherein said first biasing means further comprises connecting means attached to said spring member and said upright portion for connecting said spring member to said upright portion.

9. A clipboard as claimed in claim 1, wherein:

said base is comprised of:

a substantially rigid surface member, and;

alignment means projecting above said surface member for receiving and aligning said plurality of sheets at said positioning means above said surface member; and further comprising:

ejector means adjacent said alignment means and adapted to receive at least one of said sheets aligned by said alignment means for ejecting said sheet away from said alighment means and for spacing said sheet above the surface thereunderneath, whereby at least one additional sheet can be inserted into said space underneath said sheet and can be aligned with said alignment means.

10. A clipboard as claimed in claim 9, wherein said ejector means is mounted between said pivot means.

11. A clipboard as claimed in claim 9, wherein:

said alignment means is comprised of a plurality of pegs projecting upwardly from said surface member; and said ejector means is comprised of:

a rod connected to said pivot means parallel to said pegs;

a first strip parallel to said pegs and at least partially surrounding at least one of said pegs and mounted on said rod for rotation thereabout; and at least one projection extending downward from the underside of said first strip, whereby said first strip is spaced by the depth of the said projection above the surface thereunderneath, said projection being located between said rod and the center line of said aligned pegs.

12. A clipboard as claimed in claim 11, wherein said ejector means further comprises lifting means engagable with said first strip for lifting said first strip away from the surface thereunderneath.

13. A clipboard as claimed in claim 12, wherein said lifting means comprises a second strip mounted for rotation about said rod and engagable with said first strip, whereby lifting said second strip causes said second strip to engage and rotate said first strip and lift said first strip away from the surface thereunderneath.

14. A clipboard as claimed in claim 13, wherein:

said first strip has spaced curls along one edge thereof, a plurality of said curls being curled around said rod, and at least one of said curls extending away from said first strip;

said second strip has spaced curls along one edge thereof, a plurality of said curls being curled around said rod inbetween said curls of said first strip; and said second strip being engagable with said curl extending away from said first strip, whereby rotating said second strip about said rod causes said second strip to engage said extended curl and rotate said first strip.

* * * * *